US005704319A

United States Patent [19]

Engelhardt et al.

[11] Patent Number: 5,704,319

[45] Date of Patent: Jan. 6, 1998

[54] HYDRAULIC CLEARANCE COMPENSATION ELEMENT FOR VALVE CONTROL UNITS OF INTERNAL-COMBUSTION ENGINES

[75] Inventors: Helmut Engelhardt, Herzogenaurach; Dieter Schmidt, Nuremberg, both of Germany

[73] Assignee: INA Walzlager Schaeffler KG, Germany

[21] Appl. No.: 776,280

[22] PCT Filed: Feb. 8, 1995

[86] PCT No.: PCT/EP95/00450

§ 371 Date: Jan. 14, 1997

§ 102(e) Date: Jan. 14, 1997

[87] PCT Pub. No.: WO96/05413

PCT Pub. Date: Feb. 22, 1996

[30] Foreign Application Priority Data

Aug. 6, 1994 [DE] Germany ..... 44 27 943.4

[51] Int. Cl.[6] ..... F01L 1/24; F01L 1/46

[52] U.S. Cl. ..... 123/90.55; 123/90.49

[58] Field of Search ..... 123/90.48, 90.49, 123/90.51, 90.52, 90.55

[56] References Cited

U.S. PATENT DOCUMENTS

| | | | |
|---|---|---|---|
| 2,784,706 | 3/1957 | Humphreys | 123/90.35 |
| 3,358,660 | 12/1967 | Cornell | 123/90.55 |
| 4,864,982 | 9/1989 | Speil | 123/90.55 |
| 4,867,114 | 9/1989 | Schaeffler | 123/90.55 |
| 5,119,774 | 6/1992 | Krieg et al. | 123/90.55 |

FOREIGN PATENT DOCUMENTS

| | | |
|---|---|---|
| 3304573 | 5/1989 | Germany . |
| 4015719 | 11/1991 | Germany . |
| 3503312 | 1/1992 | Germany . |
| 4209245 | 9/1993 | Germany . |
| 619535 | 3/1949 | United Kingdom . |
| WO9319285 | 9/1993 | WIPO . |

*Primary Examiner*—Weilun Lo

*Attorney, Agent, or Firm*—Bierman, Muserlian and Lucas LLP

[57] ABSTRACT

The invention concerns a hydraulic play-compensation element including a groove (11) in the housing (1) to be located in such a way that, whatever the position of the plunger (2), a length (19) of the plunger is always supported by the cylinder wall above the groove and the securing ring (12) is centered radially around the plunger by means of a recess (14) in the plunger, the recess having a ramp at least at its lower end. The invention thus avoids weakening of the material in the upper part of the plunger.

10 Claims, 3 Drawing Sheets

Figure 2:
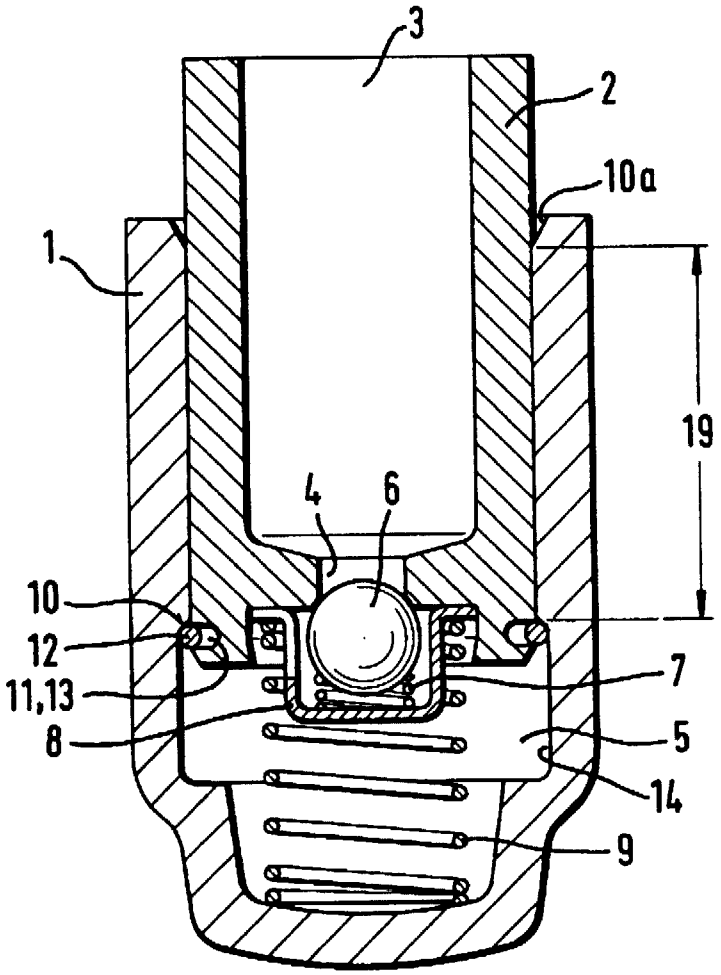

HYDRAULIC CLEARANCE COMPENSATION ELEMENT FOR VALVE CONTROL UNITS OF INTERNAL-COMBUSTION ENGINES

The invention concerns a hydraulic clearance compensation element for valve control units of internal combustion engines comprising a piston guided slidably in a housing, piston and housing defining therebetween a pressure chamber which communicates through a one-way valve arranged on a lower end of the piston with a reservoir disposed within the piston, an elastic securing ring being arranged in a circumferential groove of the housing.

Different structural embodiments of such clearance compensation elements are known such as, for example, the clearance compensation element of GB 619.535 which comprises an outer cylindrical body and a piston mounted slidably therein with slight play. A snap ring is disposed in a circumferential groove provided in an open end of the outer cylindrical body. In a position of maximum lift, a shoulder of the piston abuts against this snap ring so that the piston cannot come free of the cylindrical body. The radial dimensions of the groove and the piston are interadapted so that when the spring force is overcome during disassembly, the snap ring can be pressed by the piston into a free space within the groove i.e., the diameter of the groove is larger than the diameter of the securing ring.

One drawback of this structure is that the securing ring is not centered and can shear off during disassembly of the clearance compensation element.

A further drawback of such a securing arrangement is that the housing cannot be utilized up to its upper edge for the guidance of the piston, that is to say, the supporting length on the housing is reduced. Moreover, the annular groove reduces the cross-sectional area and thus also the strength of the piston in the upper region. The largest possible supporting length and an unweakened cross-section in the upper region are, however, particularly important in the case of short elements which are subjected to high shearing forces.

The object of the invention is therefore to improve the securing arrangement between the cylinder and the piston of a clearance compensation element using a securing ring while avoiding the hitherto encountered drawbacks.

The invention achieves this object by the fact that the groove is arranged in the housing so that a piston supporting length remains above the groove in every position of lift of the piston, and a diameter of the groove is larger than a diameter of the securing ring which is radially centered by a recess of the piston comprising a ramp at least at its lower end.

An advantage of this solution is that, because the securing ring is centered, it cannot be damaged during disassembly of the clearance compensation element. A further advantage results from the fact that the arrangement of the groove avoids a weakening of material in the upper region of the piston, and an improved guiding or supporting length is obtained between the piston and the housing because support is consistently effected at the upper end of the housing.

To begin with, the securing ring is placed in the groove. The piston is then pushed into the housing whereby the bevel on the piston centers and expands the securing ring which is thus displaced completely into the groove of the housing. When the piston is moved so far into the housing that its bevel passes the securing ring, this latter, due to its pretension, snaps back out of the groove of the housing i.e., the diameter of the securing ring becomes smaller, so that the securing ring now acts as a lock to prevent the piston from being pushed out of the housing by the force of the piston resetting spring. In the present context, a ramp is to be understood as a part inclined to the longitudinal axis of a rotationally symmetrical body and joining two regions of different diameter to each other. If, for disassembling the clearance compensation element, a force clearly larger than the force of the resetting spring of the piston is applied, the ramp of the piston presses the securing ring into the groove of the housing and the piston can be removed from the housing without any problem, the securing ring remaining permanently in the groove of the housing.

The object of the invention can likewise be achieved by arranging the groove in the piston so that in every postion of lift of the piston, a piston supporting length remains above the groove, and the diameter of the groove is smaller than the diameter of the securing ring which is radially centered by a recess in the housing comprising a ramp at least at its upper end.

This first embodiment procures the same advantages as the embodiment. For assembly, the securing ring is at first placed in the groove of the piston. On insertion of the piston into the housing, the securing ring is initially compressed by the housing wall towards the groove base. When the piston has been pushed so far into the housing that the securing ring reaches an undercut in the housing wall below the ramp, the securing ring retrieves its original size due to its pretension and forms a lock against a pushing-out of the piston from the housing by the resetting spring of the piston. For disassembling the clearance compensation element, the securing ring is pressed firmly again by the ramp of the housing wall into the groove so that the diameter of the securing ring is reduced and the piston can be pulled out of the housing without any problem. The securing ring remains permanently in the groove of the piston both during assembly and disassembly.

The securing ring may be configured as a polygonal ring.

Due to the polygonal shape of the securing ring i.e., the different diameters along the periphery of the ring, the regions having the largest diameters bear firmly against the housing groove so that the securing ring is centered. This renders a precentering of the securing ring during assembly superfluous. During disassembly of the clearance compensation element, the regions of the securing ring having the smallest diameters are expanded by the ramp provided in the recess of the piston.

If, in contrast, the groove is arranged in the piston, the polygonal ring is centered in the piston by the groove, that is to say, the regions of the securing ring having the smallest diameters bear firmly against the groove of the piston, and during disassembly of the clearance compensation element, the regions having the larger diameters are pressed by the ramp of the recess of the housing into the piston groove.

In still other developments of the invention, the piston comprises a bevel at a lower end or the housing comprises a bevel at an upper end. This facilitates the assembly of the clearance compensation element because the bevel on the piston centers and expands the securing ring while the bevel on the housing centers and compresses the securing ring.

In an advantageous development of the invention, the groove and/or the recess each comprises at least one oil transfer bore so that no additional oil supply grooves are required to be made in the housing wall or in the piston.

The securing ring is made of a metallic or a non-metallic material. The choice of the material depends on specific requirements though metallic securing rings exhibit higher pre-tension.

The invention will now be described more closely with the help of the embodiments described below and represented in the drawings.

Figure 1:
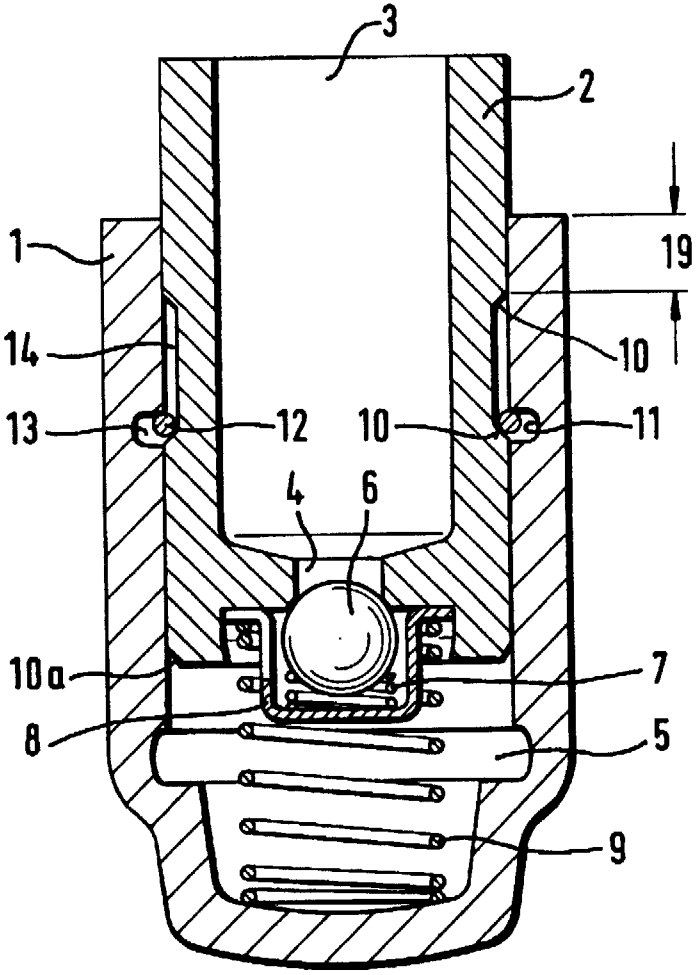
Figure 3:
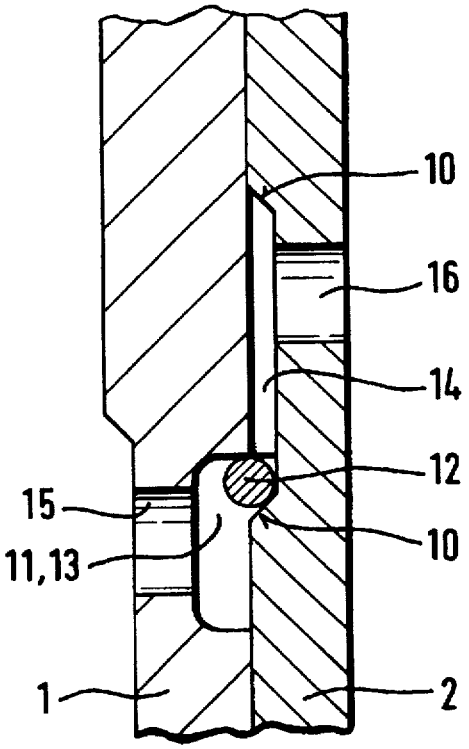
Figure 4:
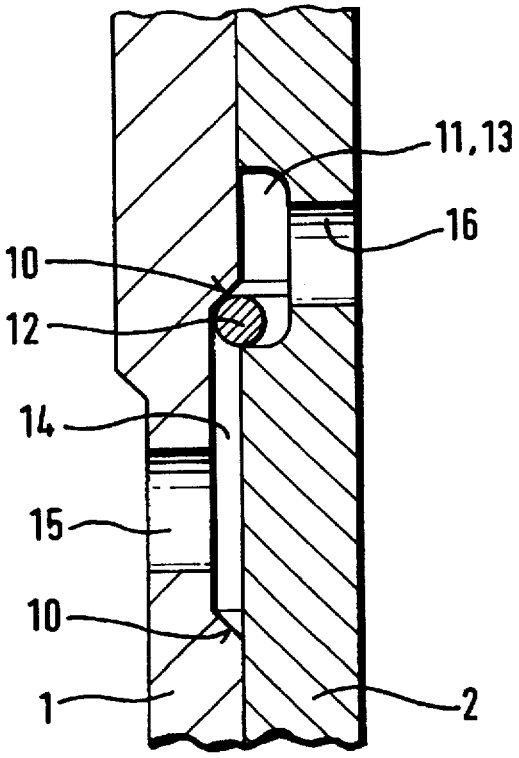
Figure 5:
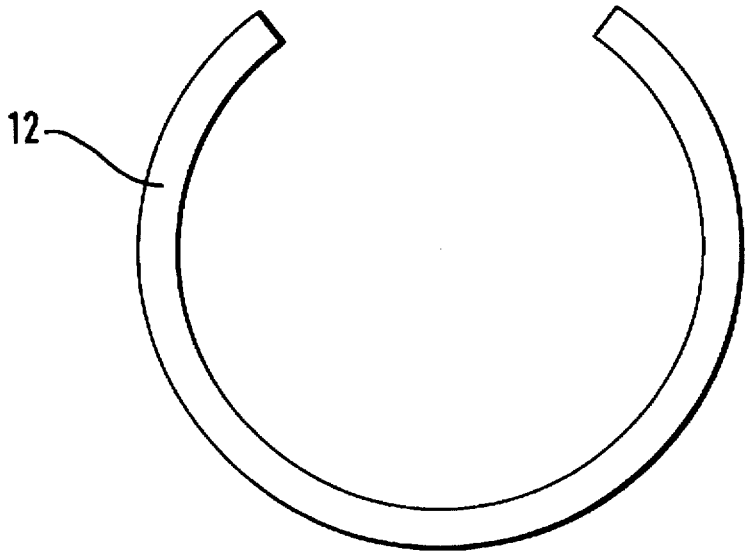
Figure 6:
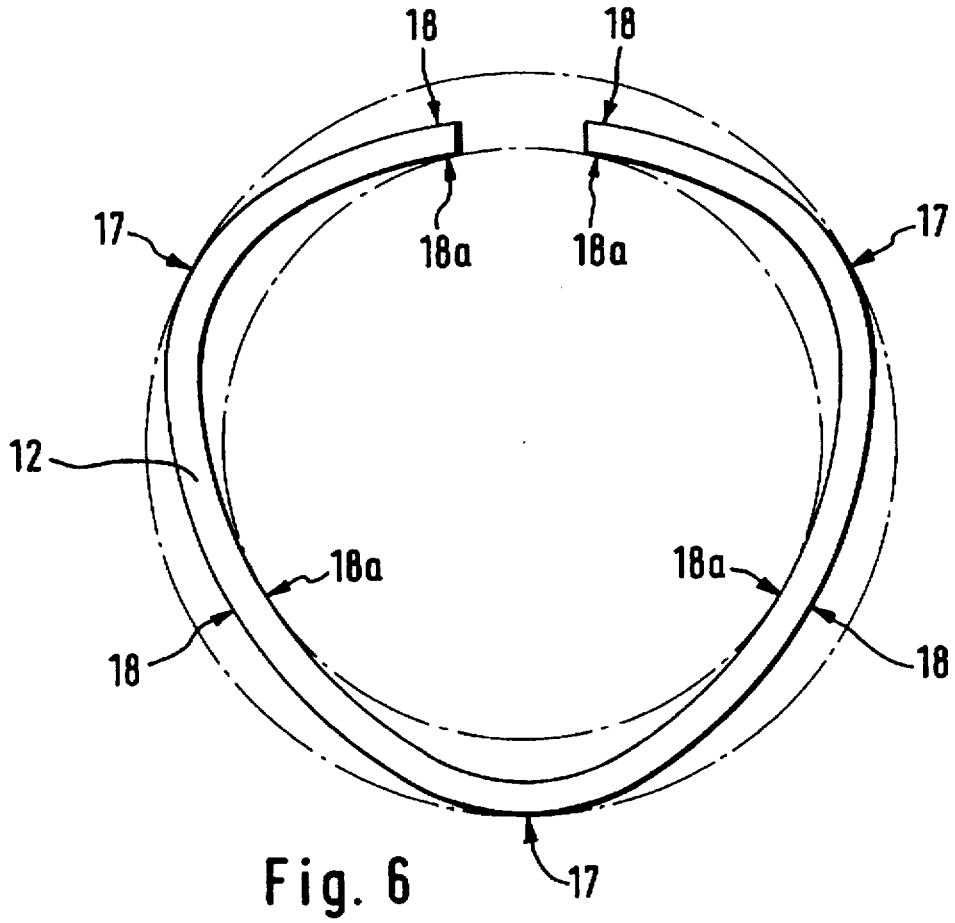

FIG. 1 is a longitudinal cross-section through a clearance compensation element in which the groove is arranged in the housing i.e., the securing ring is centered by a recess in the piston, FIG. 2 is a longitudinal cross-section through a clearance compensation element in which the groove is arranged in the piston i.e., the securing ring is centered by a recess in the housing, FIG. 3 is an enlarged representation of a securing ring arranged in the housing, FIG. 4 is an enlarged representation of a securing ring arranged in the piston, FIG. 5 is a top view of a circular securing ring, and FIG. 6 is a top view of a polygonal securing ring.

The hydraulic clearance compensation element represented in FIG. 1 is comprised essentially of a hollow outer cylindrical housing 1 which is connected to a valve stem, not represented, and a piston 2 cooperating with a rocker arm, also not represented, while being slidably guided in the housing 1 with formation of an annular gap, not referenced. The piston 2 has a hollow configuration and encloses a reservoir 3 which communicates via a bore 4 with a pressure chamber 5 defined between the piston 2 and the housing 1. The connection between the reservoir 3 and the pressure chamber 5 is controlled by a one-way valve comprising a ball 6, a spring 7 and a valve cap 8 lodging these two parts. The valve cap 8 is pressed against the piston 2 by a coil spring 9 arranged in the pressure chamber 5 and serving to reset the piston 2. In a central region of the piston 2, there is provided a recess 14 comprising a ramp 10 at each end which merges with the undiminished outer diameter of the piston. The ramp 10 comes into abutment with a securing ring 12 arranged in a groove 11 of the housing 1 and thus prevents the piston 2 from being expelled from the housing 1 by the coil spring 9.

When the securing ring 12 is of a circular shape, the radial dimensions of the securing ring 12 and the groove 11 are adapted to each other so that the diameter of the groove 11 is larger than the outer diameter of the securing ring 12. This results in the formation of a free space 13 between the securing ring 12 and the groove 11 in the installed state, into which free space 13 the securing ring 12 can be displaced during disassembly of the clearance compensation element. As already mentioned above, for assembling the clearance compensation element, the securing ring 12 is at first placed in the groove 11 of the housing 1. Following this, the piston 2 is introduced into the opening of the housing 1 and the bevel 10*a* of the piston 2 centers and expands the securing ring 12 which can thus move into the free space 13. When, however, the ramp 10 of the piston 2 reaches the groove 11, the securing ring 12 snaps back out of the free space 13 into its original position due to its pre-tension thus forming a stop for the piston 2. For disassembling the clearance compensation element, the resetting force of the spring 9 has to be distinctly exceeded so that the securing ring 12 is pressed anew into the groove 11 and the free space 13 by the ramp 10 of the piston 2. When the piston 2 has left the housing, the securing ring 12 still remains in the groove 11 and can be displaced again into the free space 13 on a renewed insertion of the piston 2.

FIG. 1 shows the piston 2 in its upper operating position i.e., the piston supporting length 19 situated above the groove 11 extends from the upper ramp 10 of the recess 14 to the upper end of the housing 1. This avoids a weakening of material in the piston 2.

As can be seen in FIG. 2, the likewise circular securing ring 12 is arranged in a groove 11 situated at the lower end of the piston 2. In this case, the radial dimensions of the securing ring 12 and the groove 11 are adapted to each other so that the inner diameter of the securing ring 12 is larger than the diameter of the groove 11. Between the securing ring 12 and the groove 11, there is likewise formed a free space 13 into which the securing ring 12 can be displaced during assembly and disassembly of the clearance compensation element. However, in order to penetrate into the free space 13, the securing ring 12 does not have to be expanded in this case but compressed. This is effected during disassembly by the ramp 10 of the housing 1 which forms a transition to the recess 14 of the housing 1. In contrast to FIG. 1, the securing ring 12 in this case remains permanently in the groove 11 of the piston 2. The piston supporting length referenced at 19 extends axially from the upper end of the groove 11 up to the bevel 10*a* of the housing 1.

From FIG. 3 it can be seen that the securing ring 12 arranged in the groove 11 of the housing 1 is centered by the recess 14 of the piston 2 i.e., the securing ring 12 bears against the recess 14. If now, for instance, during disassembly of the clearance compensation element, the resetting force of the spring 9 is considerably exceeded, the securing ring 12 is expanded by the ramp 10 of the piston 2 and can be displaced into the groove 11 and the free space 13.

As can be seen from FIG. 4 in contrast, if the securing ring 12 is arranged in the groove 11 of the piston 2, it is centered by the recess 14 of the housing 1 i.e., it bears against the housing. During disassembly, the securing ring 12 is compressed by the ramp 10 of the housing 1 and can again be displaced into the groove 11.

From the two last FIGS. 3 and 4, it can be seen further that the axial length of the groove 11 and the recess 14 are interadapted to be utilizable for oil supply. The oil passes through the bore 15, the groove 11, the recess 14 and the bore 16, or through the bore 15, the recess 14, the groove 11 and the bore 16, as the case may be, into the reservoir 3.

Two possible embodiments of the securing ring 12 are represented in FIGS. 5 and 6 viz., a circular ring and a polygonal ring. As already described above, when the circular ring of FIG. 5 is arranged in the groove 11 of the housing 1 (FIGS. 1 and 3), it is centered by the recess 14 of the piston 2 and pressed during disassembly of the clearance compensation element by the ramp 10, more particularly by the peripheral surface thereof, into the free space 13 of the groove 11 i.e., it is expanded outwards. If, on the other hand, the circular ring is arranged in the groove 11 of the piston 2 (FIGS. 2 and 4), it is centered by the recess 14 of the housing 1 i.e., it bears against the housing. During disassembly of the clearance compensation element, the ring is pressed by the ramp 10 and the inner peripheral surface of the housing 1 into the groove 11.

If, in contrast, the polygonal ring of FIG. 6 is arranged in the groove 11 of the housing 1 (FIGS. 1 and 3), it is centered by the groove itself i.e., circumferential sections 17 of the ring bear firmly against the groove 11, and during disassembly of the clearance compensation element, the ring is expanded outwards by the piston 2. In this case, however, it is only the circumferential sections 18 that are expanded.

If the polygonal ring is arranged in accordance with FIG. 2 and FIG. 4 in the groove 11 of the piston 2, it is centered by the groove itself 11 i.e., inner circumferential sections 18*a* of the ring bear firmly against the groove 11. During disassembly of the clearance compensation element, the polygonal ring is compressed by the ramp 10 and the inner peripheral surface of the housing 1 i.e., the circumferential sections 17 are pressed completely into the groove 11.

It is to be understood that the invention is not limited to the insertion element of a rocker arm described herein by way of example. The securing arrangement between the piston and the housing as dislosed by the invention can be used in a similar manner in a hydraulic support element of a finger lever or in a hydraulic cup tappet.

We claim:

1. A hydraulic clearance compensation element for valve control units of internal combustion engines comprising a piston (2) guided slidably in a housing (1), piston (2) and housing (1) defining therebetween a pressure chamber (5) which communicates through a one-way valve arranged on a lower end of the piston (2) with a reservoir (3) disposed within the piston (2), an elastic securing ring (12) being arranged in a circumferential groove (11) characterized in that the groove (11) is arranged in the housing (1) so that a piston supporting length (19) remains above the groove (11) in every position of lift of the piston (2), and a diameter of the groove (11 ) is larger than a diameter of the securing ring (12) which is radially centered by a recess (14) of the piston (2) comprising a ramp (10) at least at a lower end (FIGS. 1 and 3).

2. A hydraulic clearance compensation element for valve control units of internal combustion engines comprising a piston (2) guided slidably in a housing (1), piston (2) and housing (1) defining therebetween a pressure chamber (5) which communicates through a one-way valve arranged on a lower end of the piston (2) with a reservoir (3) disposed within the piston (2), an elastic securing ring (12) being arranged in a circumferential groove (11), characterized in that the groove (11) is arranged in the piston (2) so that a piston supporting length (19) remains above the groove (11) in every position of lift of the piston (2), and a diameter of the groove (11) is smaller than a diameter of the securing ring (12) which is radially centered by a recess (14) of the housing (1) comprising a ramp (10) at least at an upper end (FIGS. 2 and 4).

3. A hydraulic clearance compensation element of claim 1 wherein the securing ring (12) is configured as a polygonal ring (FIG. 6).

4. A hydraulic clearance compensation element of claim 1 wherein the piston (2) comprises a bevel (10*a*) at a lower end (FIG. 1).

5. A hydraulic clearance compensation element of claim 2 wherein the housing (1) comprises a bevel (10*a*) at an upper end (FIG. 2).

6. A hydraulic clearance compensation element of claim 1 wherein at least one of the groove (11) and the recess (14) comprises at least one oil transfer bore (15, 16) (FIGS. 3 and 4).

7. A hydraulic clearance compensation element of claim 1 wherein the securing ring (12) is made of a metallic or a non-metallic material.

8. A hydraulic clearance compensation element of claim 6 wherein the securing ring (12) is configured as a polygonal ring (FIG. 6).

9. A hydraulic clearance compensation element of claim 6 wherein at least one of the groove (11) and the recess (14) comprises at least one oil transfer bore (15, 16) (FIGS. 3 and 4).

10. A hydraulic clearance compensation element of claim 6 wherein the securing ring (12) is made of a metallic or a non-metallic material.

* * * * *